US006041454A

United States Patent [19]

Summerford

[11] Patent Number: 6,041,454

[45] Date of Patent: Mar. 28, 2000

[54] SHOWER CURTAIN SYSTEM

[76] Inventor: Sharon Kay Summerford, 16 W. 515 79th St., Clarendon Hills, Ill. 60514

[21] Appl. No.: 09/395,547

[22] Filed: Sep. 11, 1999

[51] Int. Cl.[7] ..... A47H 1/00

[52] U.S. Cl. ..... 4/558; 4/608; 4/610; 160/DIG. 6

[58] Field of Search ..... 4/558, 557, 607, 4/608, 610, 605; 160/368.1, DIG. 6

[56] References Cited

U.S. PATENT DOCUMENTS

| | | | |
|---|---|---|---|
| 2,303,502 | 12/1942 | Rous | 4/608 |
| 2,840,155 | 6/1958 | Stern | 4/558 |
| 3,107,361 | 10/1963 | Glutting, Sr. | 4/558 |
| 3,196,511 | 7/1965 | Kintner | 4/558 |
| 4,723,326 | 2/1988 | Tarlow et al. | 4/608 |
| 4,825,481 | 5/1989 | Lonberger | 4/608 |
| 5,339,884 | 8/1994 | Angerman | 4/608 |
| 5,651,407 | 7/1997 | Perez | 160/DIG. 6 |
| 5,894,642 | 4/1999 | Eberhardt | 160/368.1 |

*Primary Examiner*—Charles R. Eloshway

[57] ABSTRACT

A shower curtain system comprising a generally rectangular shower curtain sheet assembly having an upper horizontal edge and a lower horizontal edge and lateral vertical side edges. A plurality of coupling straps each having an interior edge and with an exterior edge positioned to be removably coupled to the sheet and with an intermediate supporting loop between the interior edge and exterior edge for being slidably received on the shower rod. A plurality of detachable weights are removably positioned on the lower edge of the shower curtain.

6 Claims, 2 Drawing Sheets

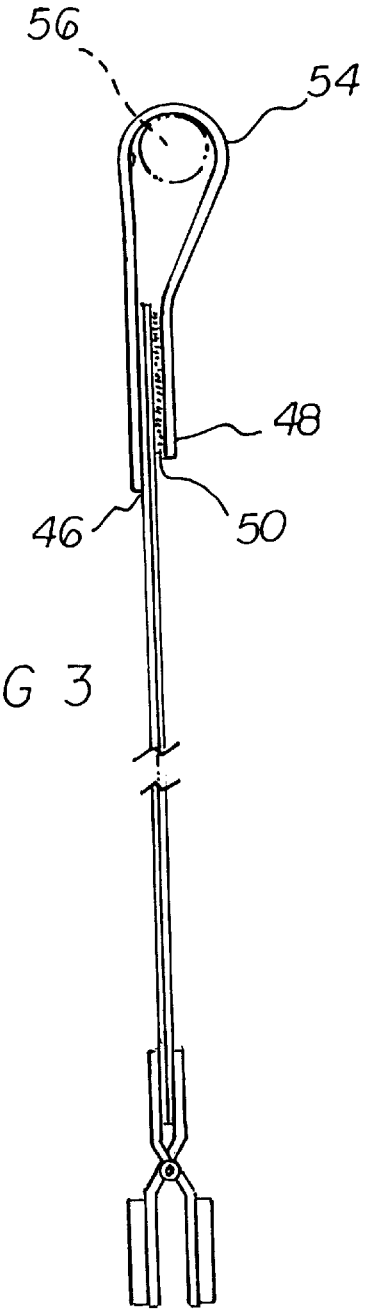
FIG 3
FIG 4A
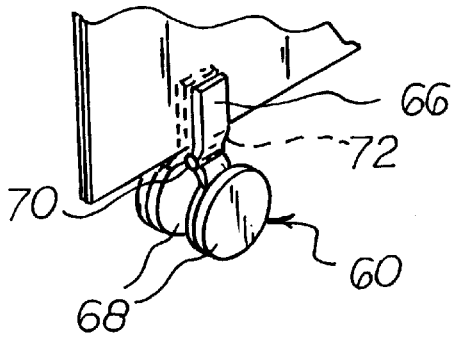
FIG 4B
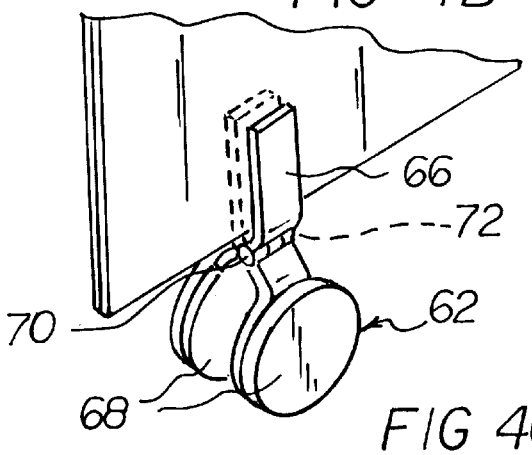
FIG 4C
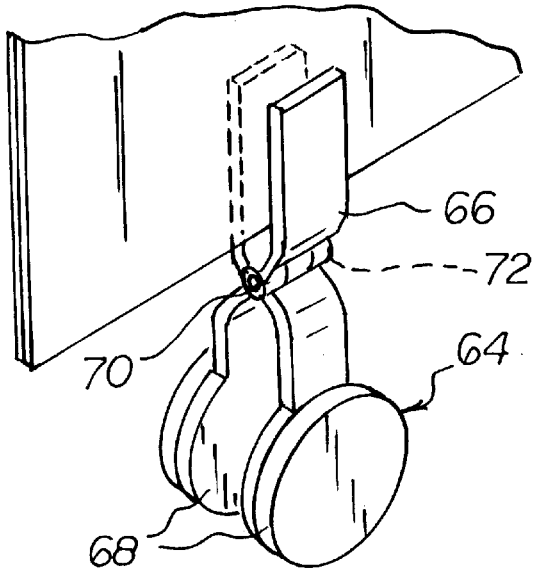

SHOWER CURTAIN SYSTEM

BACKGROUND OF THE INVENTION

1. Field of the Invention

The present invention relates to a shower curtain system with removable upper straps and removable lower weights and more particularly pertains to providing for the easy mounting and dismounting of shower curtains and for the proper hanging capabilities thereof.

2. Description of the Prior Art

The use of shower curtains and supports of known designs and configurations is known in the prior art. More specifically, shower curtains and supports of known designs and configurations heretofore devised and utilized for the purpose of hanging shower curtains through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,320,308 to Silverman discloses a curtain hook and installation. U.S. Pat. No. 2,840,155 to Stern discloses a shower curtain assembly. U.S. Pat. No. 3,196,511 to Kintner disclsoes a fastening means. U.S. Pat. No. 3,529,328 to Davison discloses a magnetic clothespin. U.S. Pat. No. 4,119,134 discloses a drapery pleat holder. U.S. Pat. No. 4,202,059 discloses a reversible shower curtain. U.S. Pat. No. 4,333,187 discloses a shower curtain. U.S. Pat. No. 5,101,877 to Subecz et al. discloses a shower curtain ensemble U.S. Pat. No. 5,2148,580 discloses a shower curtain sealing and fastening arrangement. U.S. Pat. No. 5,216,766 to Lang discloses a shower curtain rod attachment. U.S. Pat. No. 5,339,884 to Angerman discloses a shower curtain ring. U.S. Pat. No. 5,652,407 to Perez discloses a shower curtain loop. Lastly, U.S. Pat. No. Des. 362,147 discloses combined shower curtain and support elements. While these devices fulfill their respective, particular objectives and requirements, the aforementioned patents do not describe a shower curtain system with removable upper straps and removable lower weights that allows providing for the easy mounting and dismounting of shower curtain and for the proper hanging capabilities thereof.

In this respect, the shower curtain system with removable upper straps and removable lower weights according to the present invention substantially departs from the conventional concepts and designs of the prior art.

Therefore, it can be appreciated that there exists a continuing need for a new and improved shower curtain system with removable upper straps and removable lower weights which can be used for providing for the easy mounting and dismounting of shower curtains and for the proper hanging capabilities thereof.

In this regard, the present invention substantially fulfills this need.

SUMMARY OF THE INVENTION

In view of the foregoing disadvantages inherent in the known types of shower curtains and supports of known designs and configurations now present in the prior art, the present invention provides an improved shower curtain system with removable upper straps and removable lower weights. As such, the general purpose of the present invention, which will be described subsequently in greater detail, is to provide a new and improved shower curtain system with removable upper straps and removable lower weights and method which has all the advantages of the prior art and none of the disadvantages.

To attain this, the present invention essentially comprises a generally rectangular shower curtain sheet assembly. The sheet assembly has an upper horizontal edge and a lower horizontal edge. The sheet assembly also has lateral vertical side edges between the upper and lower edges. A rectangular coupling area is provided at spaced locations along the length of the upper edge. The coupling area is of a pile type fastener. The coupling area has short upper and lower horizontal edges and long vertical side edges. Included on the sheet assembly an upper central region and an upper pair of end regions. Symmetrically spaced intermediate regions are located between the central and end regions. A plurality of receptor regions are provided in association with the lower edge. The receptor regions include a central region vertically aligned with the upper central region. The receptor regions also include end regions vertically aligned with the end regions of the upper edge. Next provided are a plurality of coupling straps. Each coupling strap has an interior edge permanently coupled on the interior face of the shower curtain in proximity to the coupling area. Each strap also has an exterior edge having a pile type fastener positioned to be removably coupled to the front face of a reception area with a pile type fastener. An intermediate supporting loop is provided between the interior edge and exterior edge of the strap for being slidably received on a shower rod. A plurality of detachable weights are removably positioned on the lower edge of the shower curtain in the reception areas. Each weight is formed with upper generally parallel plates. The plates are located in closely spaced relationship positionable on opposite sides of the shower curtain. Disc shaped lower portions constitute weights. A pivot pin allows the moving together of the weights to effect the separation of the plates from the lower edge of the shower curtain. A spring is provided and functions to urge the movement of the upper regions into mating contact to be supported by the shower curtain. The weights include a set of small weights, medium weights, and heavy weights. The correct set of weights can be employed as a function of the particular application.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shower curtain system with removable upper straps and removable lower weights which has all of the advantages of the prior art shower curtains and supports of known designs and configurations and none of the disadvantages.

It is another object of the present invention to provide a new and improved shower curtain system with removable upper straps and removable lower weights which may be easily and efficiently manufactured and marketed.

It is further object of the present invention to provide a new and improved shower curtain system with removable upper straps and removable lower weights which is of durable and reliable constructions.

An even further object of the present invention is to provide a new and improved shower curtain system with removable upper straps and removable lower weights which is susceptible of a low cost of manufacture with regard to both materials and labor, and which accordingly is then susceptible of low prices of sale to the consuming public, thereby making such shower curtain system with removable upper straps and removable lower weights economically available to the buying public.

Even still another object of the present invention is to provide a shower curtain system with removable upper straps and removable lower weights for providing for the easy mounting and dismounting of shower curtains and for the proper hanging capabilities thereof.

Lastly, it is an object of the present invention to provide a new and improved shower curtain system comprising a generally rectangular shower curtain sheet assembly having an upper horizontal edge and a lower horizontal edge and lateral vertical side edges. A plurality of coupling straps each have an interior edge. Each coupling strap also has an exterior edge positioned to be removably coupled to the sheet. An intermediate supporting loop is provided between the interior edge and exterior edge for being slidably received on the shower rod. A plurality of detachable weights are removably positioned on the lower edge of the shower curtain.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 1.

FIGS. 4*a*, 4*b* and 4*c* are perspective illustrations of three types of detachable weights coupled to the bottom edge of the sheet.

The same reference numerals refer to the same parts throughout the various Figures.

DESCRIPTION OF THE PREFERRED EMBODIMENT

Figure 1:
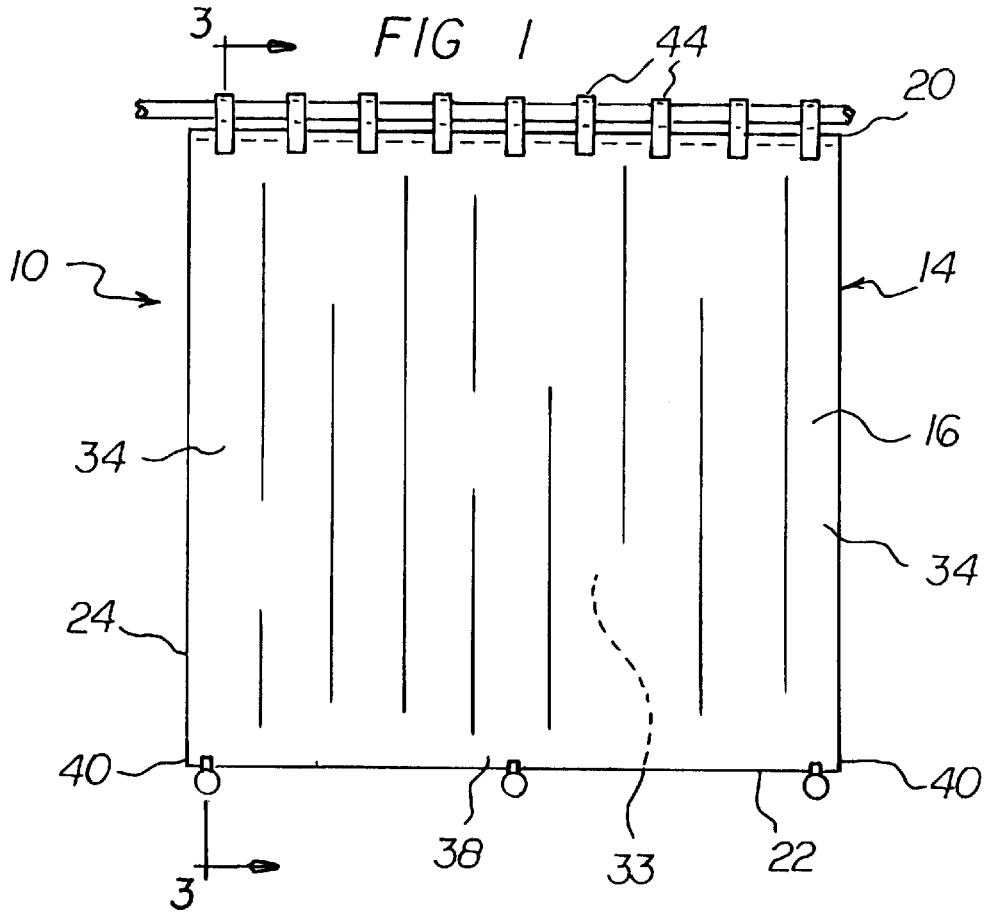
FIG. 1 is a front elevational view of the new and improved shower curtain system constructed in accordance with the principles of the present invention.

With reference now to the drawings, and in particular to FIG. 1 thereof, the preferred embodiment of the new and improved shower curtain system embodying the principles and concepts of the present invention and generally designated by the reference numeral 10 will be described.

The present invention, the shower curtain system 10 is comprised of a plurality of components. Such components in their broadest context include a generally rectangular sheet, a plurality of coupling straps, and a plurality of detachable weights. Such components are individually configured and correlated with respect to each other so as to attain the desired objective.

A generally rectangular shower curtain sheet assembly 14 is formed of plastic sheet 16. The sheet has an upper horizontal edge 20 and a lower horizontal edge 22. The sheet also has lateral vertical side edges 24 between the upper and lower edges. A rectangular coupling area 26 is provided at spaced locations along the length of the upper edge. The coupling area is of a pile type fastener 52. The coupling area has short upper and lower horizontal edges 28, 30 and long vertical side edges 32. Included on the sheet assembly are an upper central region 32 and a pair of end upper regions 34. Symmetrically spaced intermediate regions 36 are located between the central and end regions. A plurality of receptor regions 38, 40 are provided in association with the lower edge. The receptor regions include a central region 38 vertically aligned with the upper central region. The receptor regions also include end regions 40 vertically aligned with the end regions of the upper edge.

Next provided are a plurality of coupling straps 44. Each coupling strap has an interior edge 46 permanently coupled on the interior face of the shower curtain in proximity to the coupling area. Each strap also has an exterior edge 48 having a pile type fastener 50 positioned to be removably coupled to the pile type fastener 52. An intermediate supporting loop 54 is provided between the interior edge and exterior edge of the strap for being slidably received on a shower rod 56.

A plurality of detachable weights 60, 62, 64 are removably positioned on the lower edge of the shower curtain in the receptor regions. Each weight is formed with upper generally parallel plates 66. The plates are located in closely spaced relationship positionable on opposite sides of the shower curtain. Disc shaped lower portions 68 constitute weights. A pivot pin 70 allows the moving together of the weights to effect the separation of the plates from the lower edge of the shower curtain. A spring 72 is provided and functions to urge the movement of the upper regions into mating contact to be supported from the shower curtain. The weights include a set of small weights 60, medium weights 62, and heavy weights 64. The correct set of weights can be employed as a function of the particular application.

Figure 2A:
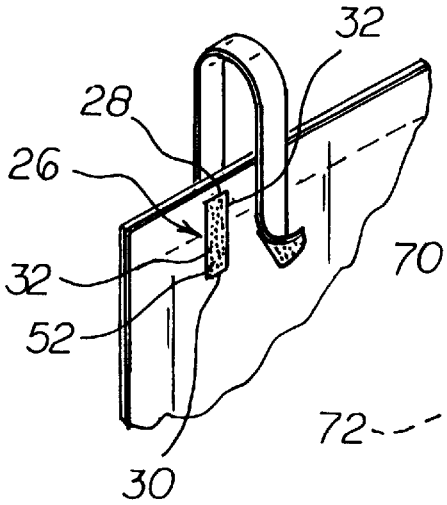
FIGS. 2*a*, 2*b*, and 2*c* are three alternate coupling strap constructions for use in association with varying coupling components at the top of the sheet.
Figure 2B:
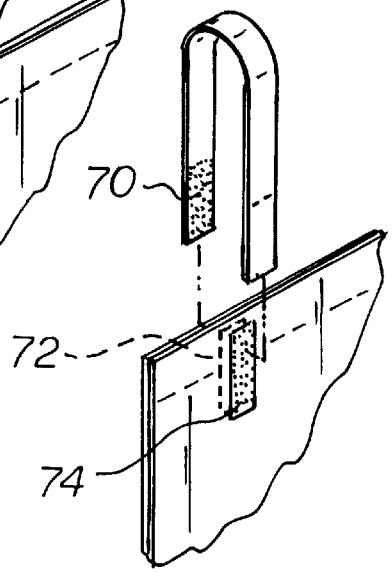
Figure 2C:
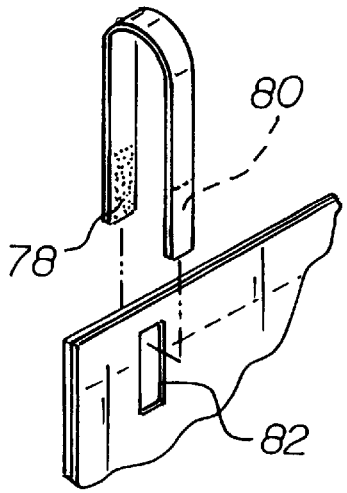

FIGS. 1 and 2A illustrate the preferred embodiment of the coupling straps. Alternate embodiments are shown in FIGS. 2B and 2C. In the FIG. 2B embodiment, each coupling strap 68 has a pile-type fastener 70 on each end adapted to removably couple to pile type fasteners 72, 74 on the interior surface and the exterior surface of the sheets. In the embodiment of FIG. C, each coupling strap has a pile type fastener 78, 80 at each end and the sheet is formed with a rectangular aperture 82 in the sheet for the coupling of the pile type fasteners of the coupling strap there between.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shower curtain kit for providing easy mounting and dismounting and proper hanging capabilities comprising, in combination:

a generally rectangular shower curtain sheet assembly formed of plastic and having an upper horizontal edge and a lower horizontal edge and lateral vertical side edges therebetween, a plurality of rectangular coupling areas of a pile type fastener, each having short upper and lower horizontal edges and long vertical side edges, the fasteners being at spaced locations along the length of the upper edge, the sheet assembly having an upper central region and a pair of upper end regions with symmetrically spaced intermediate regions therebetween, the lower edge also having in association therewith a plurality of receptor regions including a central region vertically aligned with the upper central region and having end regions vertically aligned with the end regions of the upper edge;

a plurality of coupling straps, each coupling strap having an interior edge permanently coupled on the interior face of the shower curtain sheet assembly in proximity to a respective coupling area and with an exterior edge having a mating pile type fastener positioned to be removably coupled to a respective pile type fastener along the upper edge of the sheet assembly and with an intermediate supporting loop between the interior edge and exterior edge for being slidably received on a shower rod; and a plurality of detachable weights removable positionable on the lower edge of the shower curtain in the reception areas, each weight formed with upper generally parallel plates in closely spaced relationship positionable on opposite sides of the shower curtain and with disc shaped lower portions which constitute weights with a pivot pin therebetween to allow the moving together of the weights to effect the separation of the plates from the lower edge of the shower curtain and with a spring to urge the movement of the upper regions into mating contact to be supported from the shower curtain, the weights comprising a set of light weights, and medium weights, and heavy weights.

2. A shower curtain kit comprising:

a generally rectangular shower curtain sheet assembly having an upper horizontal edge and a lower horizontal edge and lateral vertical side edges there between;

a plurality of coupling straps connected to the upper edge of the sheet, each coupling strap having an interior edge and with an exterior edge positioned to be removably coupled to the sheet and with an intermediate supporting loop between the interior edge and exterior edge for being slidably received on the shower rod;

a plurality of detachable weights removably positionable on the lower edge of the shower curtain; and wherein the weights include upper generally parallel plates in closely spaced relationship positionable on opposite sides of the shower curtain and with disc shaped lower portions to constitute weights with a pivot pin therebetween to allow the moving together of the weights to effect the separation of the plates from the lower edge of the shower curtain and with a spring to urge the movement of the upper regions into mating contact to be supported from the shower curtain.

3. The system as set forth in claim 2 wherein the weights comprise a set of light weights and medium weights and heavy weights.

4. The system as set forth in claim 2 wherein each strap has its interior edge secured to the interior surface of the sheet and with its exterior edge formed with a pile type fastener adapted to couple to a respective one of a plurality of pile type fasteners positioned on the sheet.

5. The system as set forth in claim 2 wherein each coupling strap has a pile type fastener on each edge adapted to removably couple to respective pair of a plurality of pairs of a pile type fasteners on the interior surface and the exterior surface of the sheet.

6. The system as set forth in claim 2 wherein each coupling strap has mating pile type fasteners at each edge and the sheet is formed with a rectangular aperture in the upper edge for the coupling of the pile type fasteners of the coupling strap there through.

* * * * *